US007165994B2

(12) United States Patent
Ferry et al.

(10) Patent No.: US 7,165,994 B2
(45) Date of Patent: Jan. 23, 2007

(54) ELECTRICAL CONNECTOR HAVING A GROUND PLANE WITH INDEPENDENTLY CONFIGURABLE CONTACTS

(75) Inventors: Joshua L. Ferry, Georgetown, IN (US); Brian R. Vicich, Prospect, KY (US); Julian J. Ferry, Dillsburg, PA (US)

(73) Assignee: Samtec, Inc., New Albany, IN (US)

( * ) Notice: Subject to any disclaimer, the term of this patent is extended or adjusted under 35 U.S.C. 154(b) by 27 days.

(21) Appl. No.: 10/879,901

(22) Filed: Jun. 29, 2004

(65) Prior Publication Data

US 2004/0235323 A1 Nov. 25, 2004

Related U.S. Application Data

(60) Continuation-in-part of application No. 10/822,341, filed on Apr. 12, 2004, which is a division of application No. 09/863,960, filed on May 23, 2001, now Pat. No. 6,739,884.

(51) Int. Cl.
*H01R 13/648* (2006.01)

(52) U.S. Cl. ..... 439/607

(58) Field of Classification Search ..... 439/95, 439/607, 108, 885
See application file for complete search history.

(56) References Cited

U.S. PATENT DOCUMENTS 3,473,219 A * 10/1969 Randar et al. ..... 29/863
3,587,029 A * 6/1971 Knowles ..... 439/607
4,602,832 A 7/1986 Cunningham et al.
4,619,495 A * 10/1986 Sochor ..... 439/637
4,718,867 A 1/1988 Seidel et al.
4,975,084 A 12/1990 Fedder et al.
5,141,445 A 8/1992 Little
5,174,770 A 12/1992 Sasaki et al.
5,175,928 A 1/1993 Grabbe
5,261,829 A 11/1993 Fusselman et al.
5,342,211 A 8/1994 Broeksteeg
5,411,415 A 5/1995 Embo et al.
5,429,520 A 7/1995 Morlion
5,429,528 A 7/1995 Longueville et al.
5,456,616 A 10/1995 Fuerst et al.
5,527,740 A 6/1996 Golwalkar et al.
5,542,851 A * 8/1996 Chikano ..... 439/108
5,549,481 A 8/1996 Morlion et al.
5,586,893 A 12/1996 Mosquera
5,597,326 A 1/1997 DeLessert et al.

(Continued)

FOREIGN PATENT DOCUMENTS

EP 538029 * 4/1993

*Primary Examiner*—Neil Abrams
(74) *Attorney, Agent, or Firm*—Keating & Bennett, LLP

(57) ABSTRACT

An electrical connector includes a housing, a plurality of contact pins, and at least one shield plane provided on the outside of the housing. Some of the contact pins are electrically connected to the at least one shield plane to define shield contact pins and some of the contact pins are not electrically connected to the at least one shield plane to define signal contact pins. In one embodiment, the shield plate includes deformable finger portions to be pressed against selected contact pins. In another embodiment, the contacts include shield engaging contact arms, some of which are to be removed while others remain. The removal may be performed while the contacts are on a carrier strip.

5 Claims, 16 Drawing Sheets

U.S. PATENT DOCUMENTS 5,620,340 A 4/1997 Andrews
5,697,799 A 12/1997 Consoli et al.
5,730,609 A * 3/1998 Harwath ..... 439/108
5,919,063 A 7/1999 Wang
6,019,616 A * 2/2000 Yagi et al. ..... 439/108
6,039,583 A 3/2000 Korsunsky et al.
6,089,882 A 7/2000 Costello
6,095,864 A 8/2000 Yu et al.
6,241,531 B1 6/2001 Roath et al.
6,273,758 B1 8/2001 Loyd et al.
6,299,481 B1 10/2001 Doi
6,464,515 B1 * 10/2002 Wu ..... 439/108

* cited by examiner

ELECTRICAL CONNECTOR HAVING A GROUND PLANE WITH INDEPENDENTLY CONFIGURABLE CONTACTS

This is a Continuation-in-Part Application of U.S. patent application Ser. No. 10/822,341, filed Apr. 12, 2004, currently pending, which is a Divisional of U.S. patent application Ser. No. 09/863,960, filed May 23, 2001, now U.S. Pat. No. 6,739,884.

BACKGROUND OF THE INVENTION

1. Field of the Invention

The present invention generally relates to electrical connectors, and more particularly to an electrical connector having improved electrical characteristics including improved impedance matching, minimized crosstalk and significantly reduced emission and absorption of electromagnetic interference ("EMI").

2. Description of the Related Art

Electrical connectors are used to place electrical devices, such as printed circuit boards, in electrical communication with one another. Typically, an electrical connector includes a set of electrical contacts that are adapted to receive a first set of pins from the first device to be coupled. The set of contacts extends from the electrical connector and terminates in a second set of pins that connect to the second device to be coupled, placing the two devices in electrical communication with each other through the electrical connector.

In order to minimize high frequency noise, it is desirable to provide a ground plane near the electrical contacts in the electrical connector, the ground plane being connected to ground potential. Typically, one or more of the electrical contacts will be coupled to the ground plane. Known electrical connectors are typically provided with certain predetermined electrical contacts connected to the ground plane. Accordingly, unique electrical connectors must normally be provided for each pair of devices to be interconnected.

The current trend towards miniaturization of electrical devices allows for smaller, faster devices with increased memory and decreased cost, but also means a greater number of electrical connections have to be made in a smaller volume to accommodate communications between devices. As the number of electrical connections in a given volume increases, so does the potential for problems such as crosstalk between the connections. In addition, there is a need for impedance matching between electronic components used on the printed circuit boards.

In order to solve the problems with EMI between a connector and adjacent electronic components, a conventional connector has one or two metal planes or shields disposed on outer surfaces of the connector housing or body. These metal shields reduce EMI that the connector emits from being emitted outside of the connector, while also reducing EMI emitted by adjacent electronic components from being transmitted to the connector. In order to improve the performance of the metal shields, some of the connector contacts are electrically connected to the shield on a male connector and thus, connect the PCB to the shield. When such a male connector is mated with a female connector, contacts on the female connector mate to the shield provided on the male connector in order to create an electrical connection between one PCB and the other. The pattern of contacts that is connected to the shield is determined beforehand and is unique to each connector. Thus, this pattern of shielded contacts cannot be easily customized according to a specific application.

In conventional connectors, there are specifically designated shield contacts which are contacts in the connector that are electrically connected to the shield provided on the connector, and there are specifically designated signal contacts that are provided in the connector to carry signals into and out of the connector. These shield contacts and signal contacts are unique to each type of connector and must be specifically designed and arranged for each connector.

Similarly, the shield or metal housing on the outside surfaces of the connector is specific to each type of connector. The shield is specifically formed according to the size of the connector, the number of shield contacts required and the pattern of shielding and shield contacts required.

Thus, for each connector, a different configuration of signal contacts, shield contacts and shields must be manufactured. This greatly increases the cost and difficulty of connector manufacturing.

In addition, other conventional devices have utilized a ground plane, such as a center plane, disposed between adjacent rows of contacts of a connector, to prevent adjacent rows of pins or contacts from interfering with each other, thereby reducing crosstalk and improving impedance control. More intricate arrangements of such ground planes or shields have also been proposed.

For example, one method of providing shielding for an electrical connector is discussed in U.S. Pat. No. 5,620,340. The '340 patent discloses the use of arrays of square-wave shaped shield plates to form rectangular boxes around groups of electrical contact pins to shield them from other, neighboring pins. While the shielding configuration of this patent reduces crosstalk, it is difficult and expensive to mass produce connectors using the square-wave shaped shielding pieces, since it is difficult to maintain proper alignment of a large number shielding pieces having such a complex shape.

In addition, U.S. Pat. No. 6,299,481 discloses a shielded connector having a shield cover that is substantially U-shaped and is arranged to cover an upper surface, a lower surface and a front surface of an insulative connector housing and electrical contacts or terminals disposed therein. However, this arrangement also suffers from the problems described above.

SUMMARY OF THE INVENTION

In order to overcome the problems described above, preferred embodiments of the present invention provide an electrical connector that has a relatively simple and easily customizable construction in which electrical disturbances such as EMI and crosstalk are minimized while also achieving impedance matching.

According to one preferred embodiment of the present invention, an electrical connector includes a housing, a plurality of electrical contacts disposed in the housing, and at least one shield member provided on an outer surface of the housing, wherein a first group of the plurality of electrical contacts are electrically connected to the at least one shield member to define shield contacts and a second group of the plurality of electrical contacts are not electrically connected to the at least one shield member to define signal contacts.

The housing is preferably made of an insulating material such as plastic and may include one or more cavities for containing the electrical contacts therein.

The electrical contacts are preferably made of a conductive material such as copper, or other suitable material, and may be arranged in one or more rows inside of the housing. The electrical contacts preferably have a unique configuration. The electrical contacts are first formed to have the same structure and then are modified to form the signal contacts and the shield contacts. More specifically, each of the electrical contacts initially includes a main portion for being disposed in the inside of the housing, a bottom portion extending from the main portion and along a bottom of the housing so as to be connectable to a conductive element on a substrate on which the connector is mounted, and an arm portion extending from the bottom portion for contacting the at least one shield member. For those electrical contacts that define the signal contacts, the arm portion is removed, preferably by cutting, so as to form a burr portion. The burr portion is spaced from the at least one shield member when the contacts are inserted into the housing so as to prevent any electrical contact between the signal contacts and the at least one shield member. The arm portions that remain on the electrical contacts that define the shield contacts are arranged so as to contact the at least one shield member on an outside of the housing.

Once the shield contacts and signal contacts are formed as described above, a unique pattern of shield contacts and signal contacts is produced such that at least one of the signal contacts is adjacent to at least one of the shield contacts.

The at least one shield member is preferably a shield plane or plate but may be any type of shield member. The shield member may also be configured in one or more separate bodies which are preferably substantially rectangular, plate-like bodies disposed on one or more outer surfaces of the housing.

The connector may also include one or more ground members disposed within the housing. The ground member may be a ground plane or blade disposed within the housing and preferably between rows of the electrical contacts, along a longitudinal axis of the housing.

In at least one specific preferred embodiment of the present invention, the plurality of electrical contacts are arranged in at least four rows substantially parallel to each other and provided in the housing, at least two ground planes are provided in the housing between each pair of the at least four rows of contacts, and at least four shield planes are provided on at least two outside surfaces of the housing and electrically connected to selected ones of the plurality of contacts.

According to another preferred embodiment of the present invention, a producing an electrical connector includes the steps of providing a housing, providing at least one shield member along an outer surface of the housing, and forming a plurality of electrical contacts for defining signal contacts and shield contacts, and inserting the plurality of electrical contacts into the housing such that a first group of the electrical contacts are electrically connected to the at least one shield member so as to define the shield contacts and a second group of the electrical contacts are not electrically connected to the at least one shield member so as to define the signal contacts.

The step of forming the plurality of electrical contacts preferably includes forming the plurality of electrical contacts while the contacts are attached to a carrier strip, and eliminating a portion of the electrical contacts that define the signal contacts, preferably by cutting the arm portion of the contacts.

This step of eliminating a portion of the electrical contacts can be performed either before or after the contacts are inserted into the housing.

When the electrical contacts are inserted into the housing, the arm portions of the shield contacts are engaged with the at least one shield member so as to electrically connect the shield contacts to the at least one shield member.

In addition, in a preferred embodiment of the present invention, the step of forming the plurality of electrical contacts includes a first step of forming the plurality of electrical contacts on a carrier strip to have the same structure, and a second step of modifying the structure of the plurality of electrical contacts that define the signal contacts to produce a customized pattern of signal contacts and shield contacts along the carrier strip, preferably by removing a portion of the signal contacts.

According to another preferred embodiment of the present invention, the step of inserting the plurality of electrical contacts includes a first step of inserting the plurality of electrical contacts into the housing such that all of the electrical contacts are electrically connected to the at least one shield member, and a second step of removing a portion of selected ones of the plurality of electrical contacts to eliminate the electrical connection with the at least one shield member.

The method according to various preferred embodiments of the present invention may also include inserting at least one ground member inside of the housing, and preferably between two or more rows of the electrical contacts.

Another preferred embodiment of the present invention relates to electrical connector having at least one ground plate adapted to be electrically connected to a ground potential, wherein the ground plate includes a plurality of substantially parallel elongated, bendable fingers. Each finger is spaced from every other finger in the ground plate and may be independently bent inwardly. In one embodiment, the electrical connector also includes a plurality of electrically conducting members or contacts, preferably formed on the edge or surface of a printed circuit board or card. The electrically conducting members are positioned adjacent to the ground plate(s), such that when a ground plate finger is bent inwardly, it can make selective and independent electrical contact with a preselected electrically conducting member. Preferably, the electrical connector includes a pair of ground plates oriented substantially in parallel, such that the fingers of each ground plate may be bent inwardly towards the opposite ground plate to define plurality of electrically interconnected electrically conducting members held firmly by the fingers of the two ground plates.

One object of the present invention is to provide an improved electrical connector device. Related objects and advantages of the present invention will be apparent from the following description.

Other features, elements, characteristics and advantages of the present invention will become more apparent from the following detailed description of preferred embodiments with reference to the attached drawings.

DETAILED DESCRIPTION OF PREFERRED EMBODIMENTS

Figure 1:
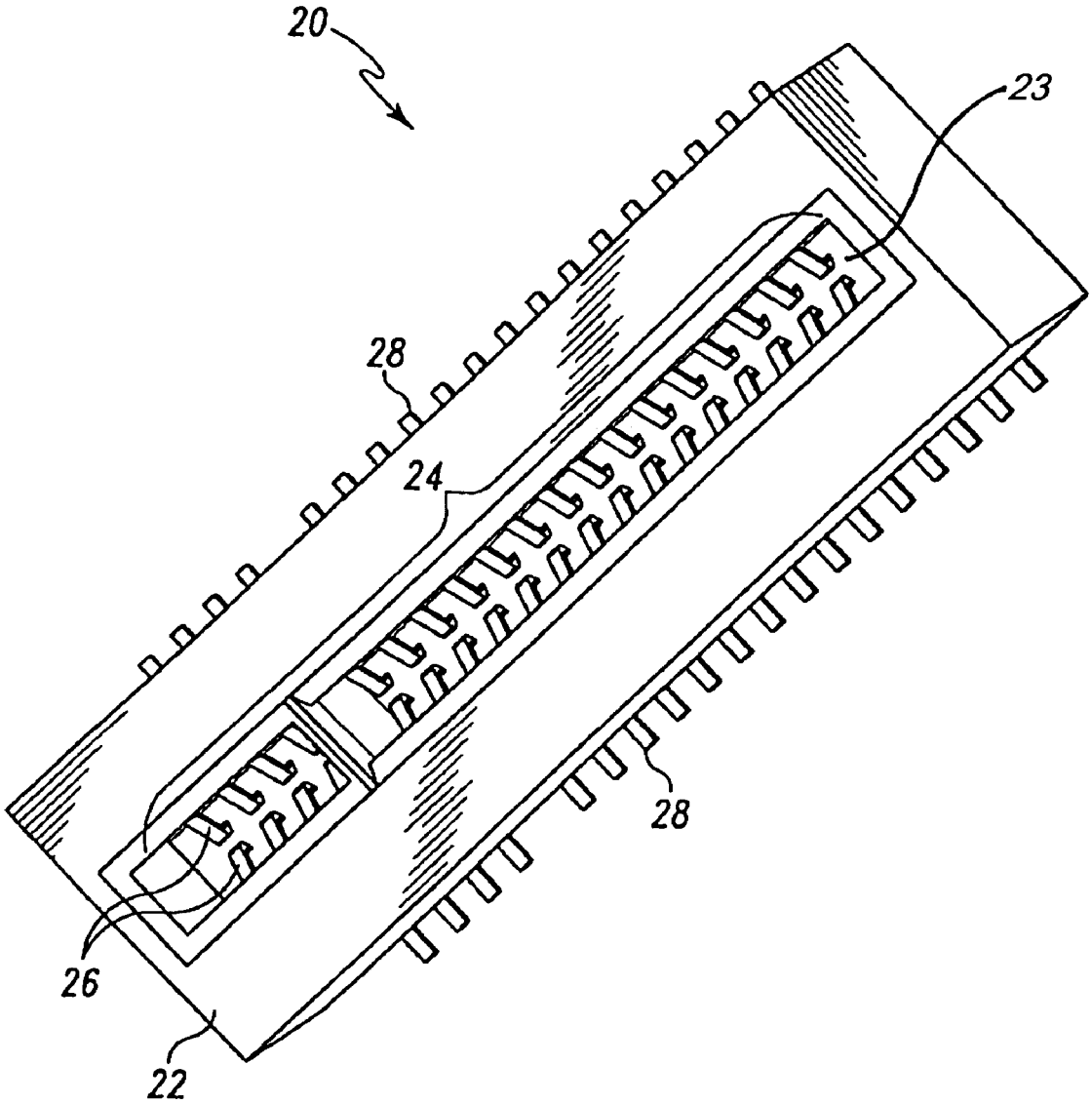
FIG. 1 is a top perspective view of a first embodiment electrical connector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
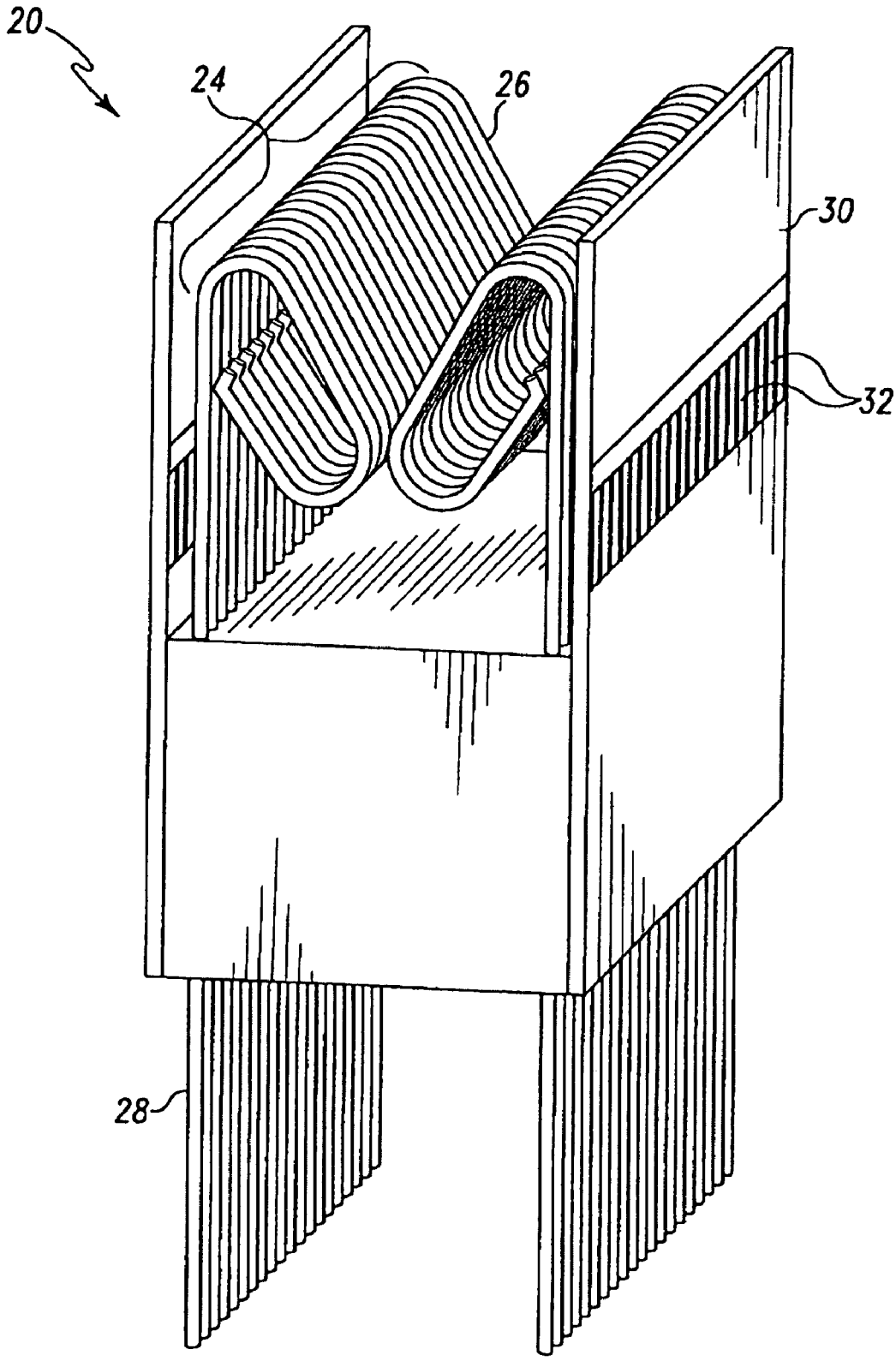
FIG. 2 is a partial side perspective view of the embodiment of FIG. 1, with the housing removed therefrom.
Figure 3:
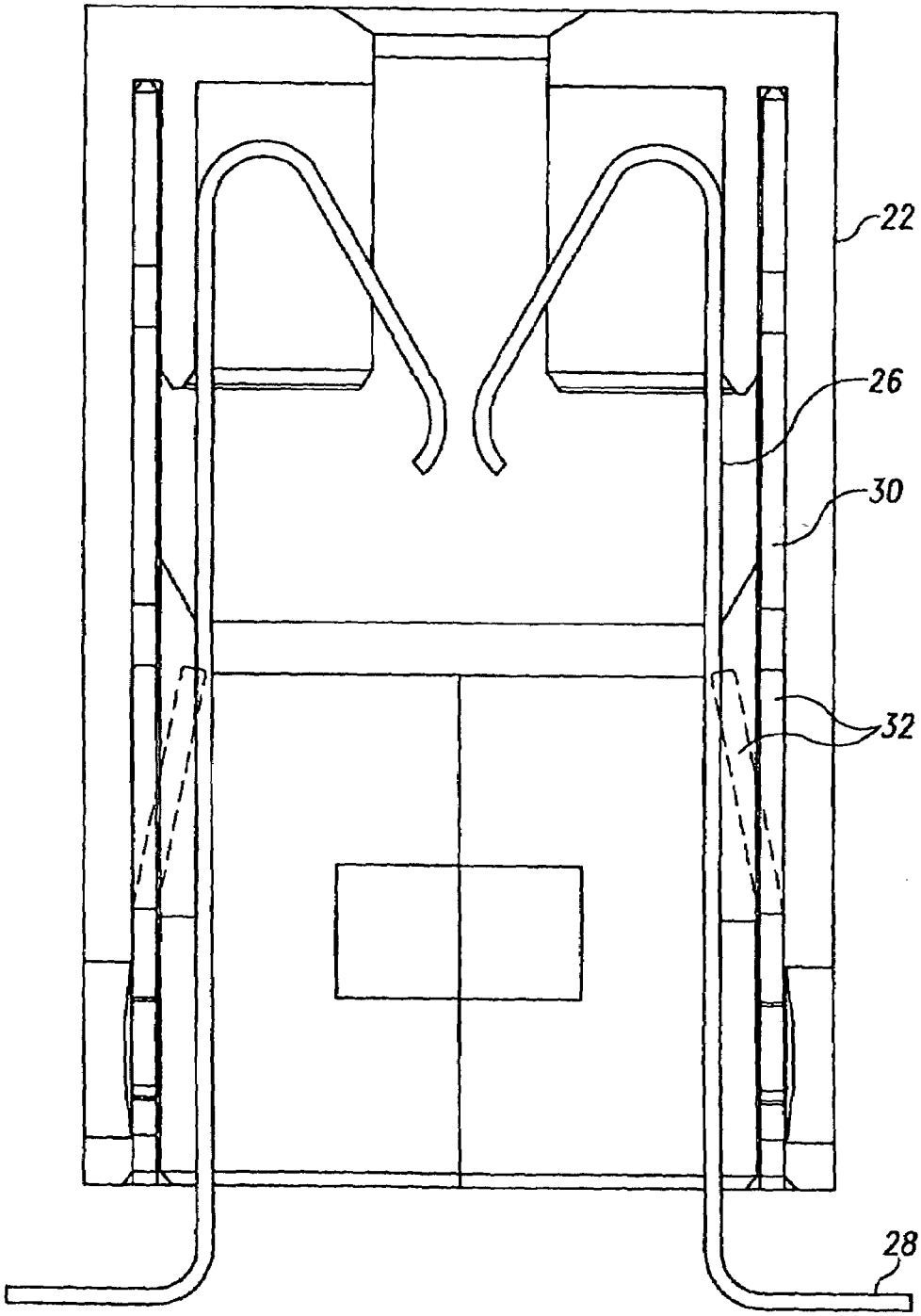
FIG. 3 is a side sectional schematic view of the embodiment of FIG. 1.

FIGS. 1–4A illustrate a first embodiment of the present invention, an edge-type electrical connector 20 for receiving a plurality of electrical contacts and independently configurable to provide any desired pattern of grounding thereto. Referring to FIGS. 1–3, the electrical connector includes a housing portion 22 having a generally open top slot for receiving electrical contacts (generally conductive pads on the edge of a printed circuit board). The housing 22 further contains a plurality of electrical contact receptors or sockets 24 for receiving the individual electrical contacts and holding them in electric communication with a plurality of respective conductors 28. The plurality of electrical contact receptors 24 is generally arranged in a single row, although the plurality of electrical contact receptors 24 could be arranged in two or more parallel rows. As illustrated in FIG. 1, each electrical contact receptor 24 comprises a pair of elongated electrically conducting members 26 positioned opposite each other and having a separation distance therebetween of slightly less that the width of a received contact, such that a contact inserted therebetween would be held in electrical communication with the electrical contact receptor 24 by the spring forces generated by the elastically deflected electrically conducting members 26. While electrical contact receptors 24 comprising multiple pairs of elongated electrically conducting members 26 are preferred, any convenient electrical contact receptor configuration may be selected, such as sockets or the like. The electrical contact receptors 24 terminate in electrical conductors 28 extending from the housing 22. The conductors 28 may be bent away from the housing, if desired (see FIG. 1) or left straight (see FIG. 2).

The housing 22 further includes one or more ground plates 30 positioned therein and oriented substantially parallel to the row of electrical contact receptors 24. FIG. 2 illustrates the connector 20 with the housing 22 removed. The ground plates 30 are formed of an electrically conductive material, such as copper, steel, an alloy, or the like. The ground plates 30 are preferably substantially planar and are more preferably positioned substantially parallel to the row of electrical contact receptors 24. The ground plates 30 include a plurality of individual elongated finger portions 32 formed therein. The finger portions 32 preferably extend parallel to the electrically conducting members 26 and are positioned such that each electrically conducting member 26 is spaced opposite a finger portion 32. In other words, each electrically conducting member 26 and at least one respective finger portion 32 are positioned substantially adjacently, such that the finger portion 32 may be bent sufficiently inwardly toward the electrical conducting member 26 to make electrical contact therewith.

Figure 4A:
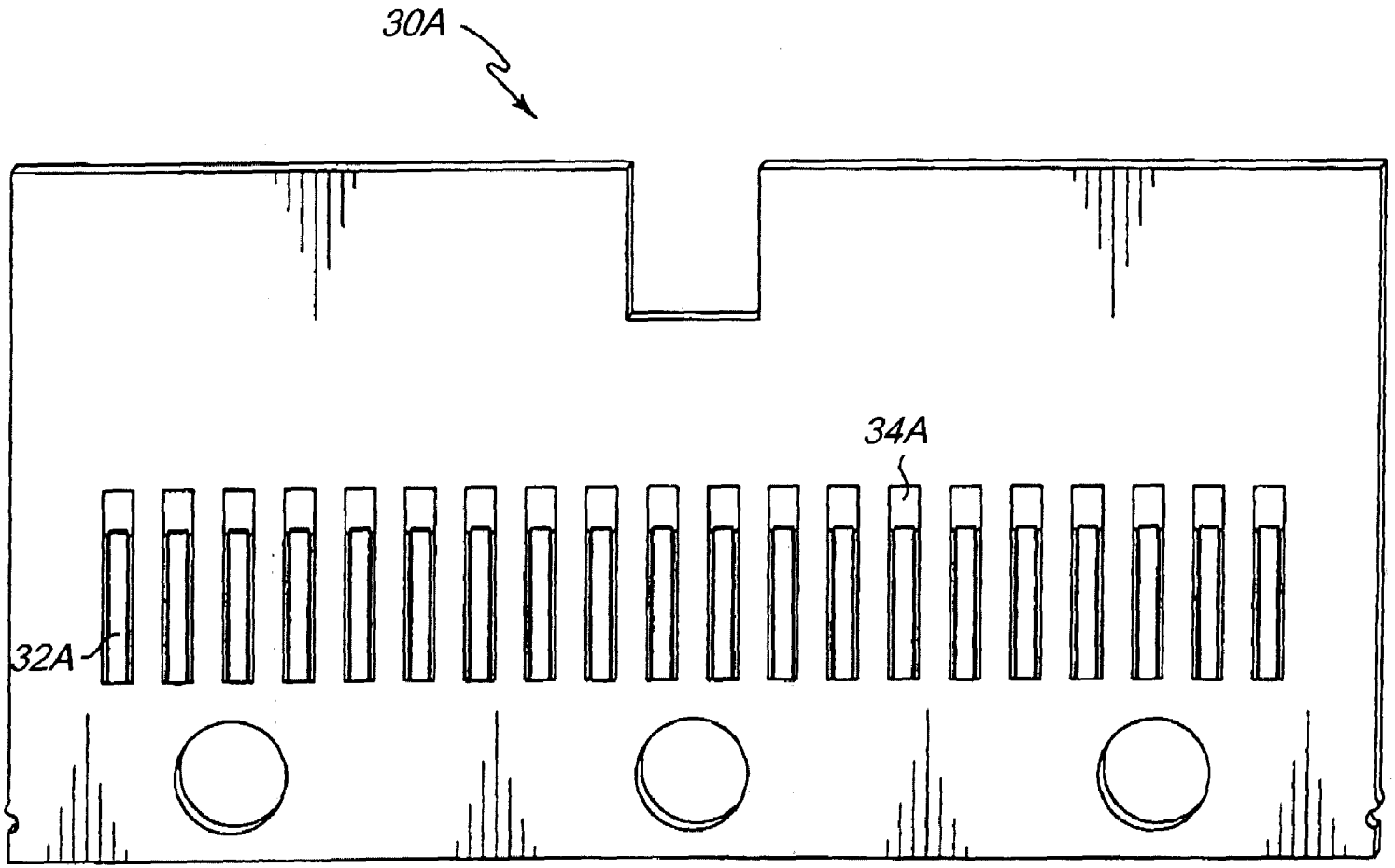
FIG. 4A is a side elevational view of the ground plate of FIG. 2.
Figure 4B:
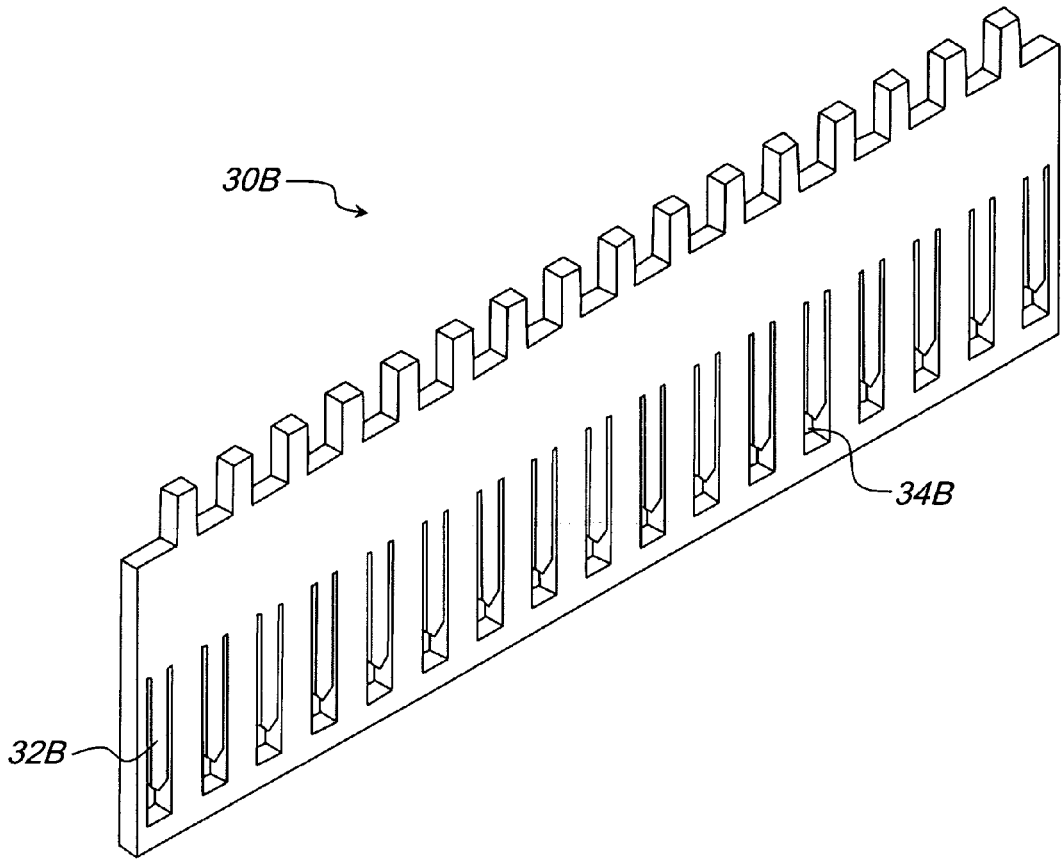
FIG. 4B is a side elevational view of an alternate embodiment ground plate.
Figure 5:
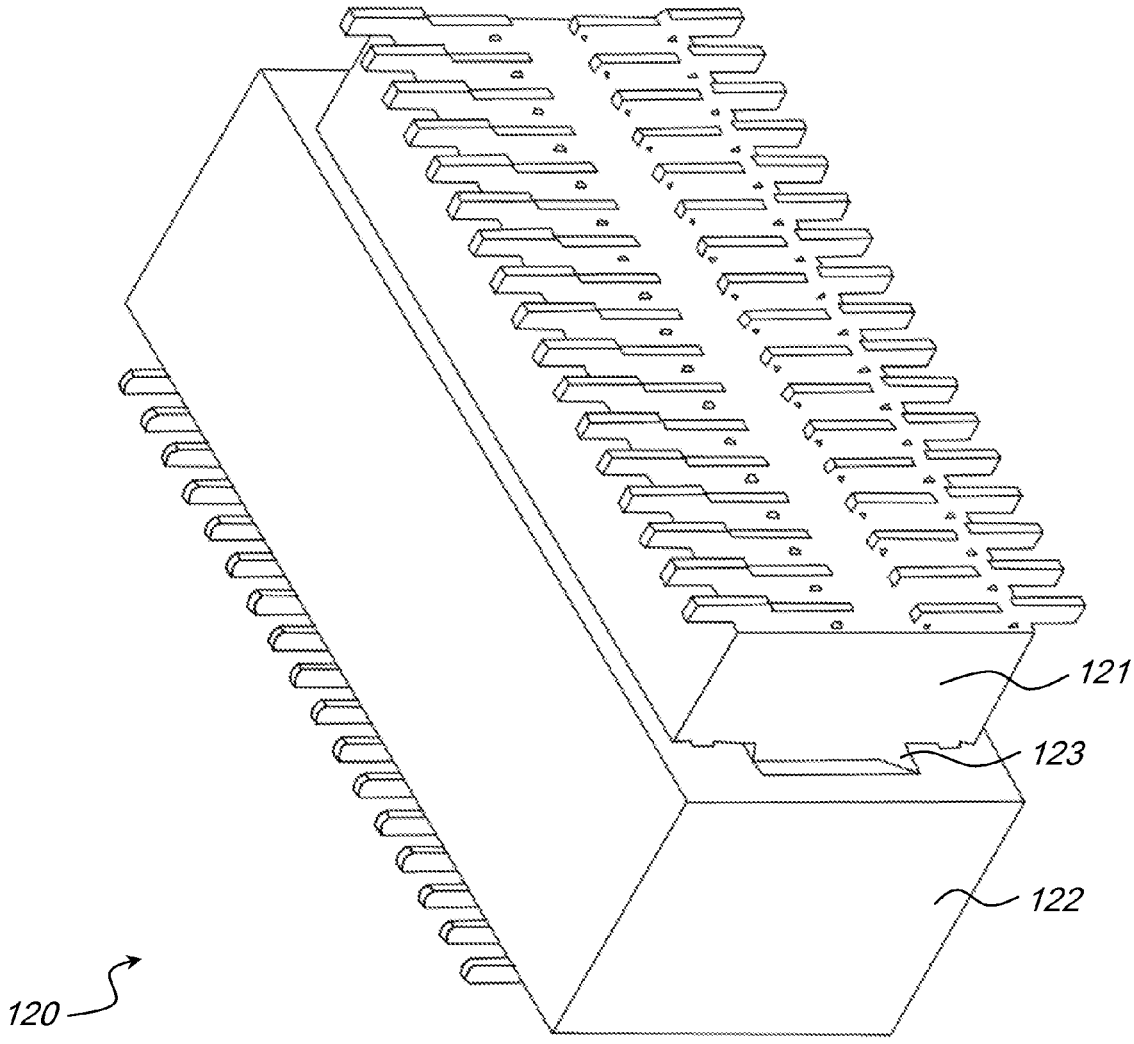
FIG. 5 is a perspective view of a second embodiment electrical connector of the present invention.

Referring to FIGS. 4A and 4B, the ground plates 30 are discussed in greater detail. Each finger portion 32 is preferably defined by a (preferably rectangular) window 34. Each finger portion 32 extends from the ground plate 30 on one side of the window 34 and extends into the window 34 therefrom. The finger portion 32 is preferably an elongated rectangular member extending within the window portion 34 and is more preferably centered therein. The window portions 34 need not be discrete. In other words, the finger portions 32 may be spaced such that there is a gap between each finger portion 32 that is not filled by solid ground plate material. Additionally, the finger portions 32 may be formed with substantially no window portions 34. Referring to the ground plate 30 illustrated in FIG. 4B, the ground plate 30 further includes mounting portions 35 for securely attaching the ground plate 30 to the rest of the electrical connector 20.

The electrical connector 20 is preferably produced with all of the finger portions 32 oriented flush with their respective ground plate 30. In other words, the finger portions 32 are preferably unbent when the electrical connector 20 is produced, although the electric connector 20 may be produced with one or more of the finger portions 32 bent. The electrical connector 20 may therefore be readily modified to have any desired connector ground pin configuration by simply bending the appropriate fingers 32 inwardly to ground the desired electrical contact receptor 24 positions (the bending may be done manually by the end user, mechanically, or during the stamping or forming process). The electrical connector 20 may thusly be customized at any time after production, increasing its utility and flexibility of use. Customization may be done in bulk following manufacture to address a technical requirement. Alternately, the electrical connectors 20 may be sold as manufactured and customized in the field to meet the specific needs of an individual user.

Figure 6:
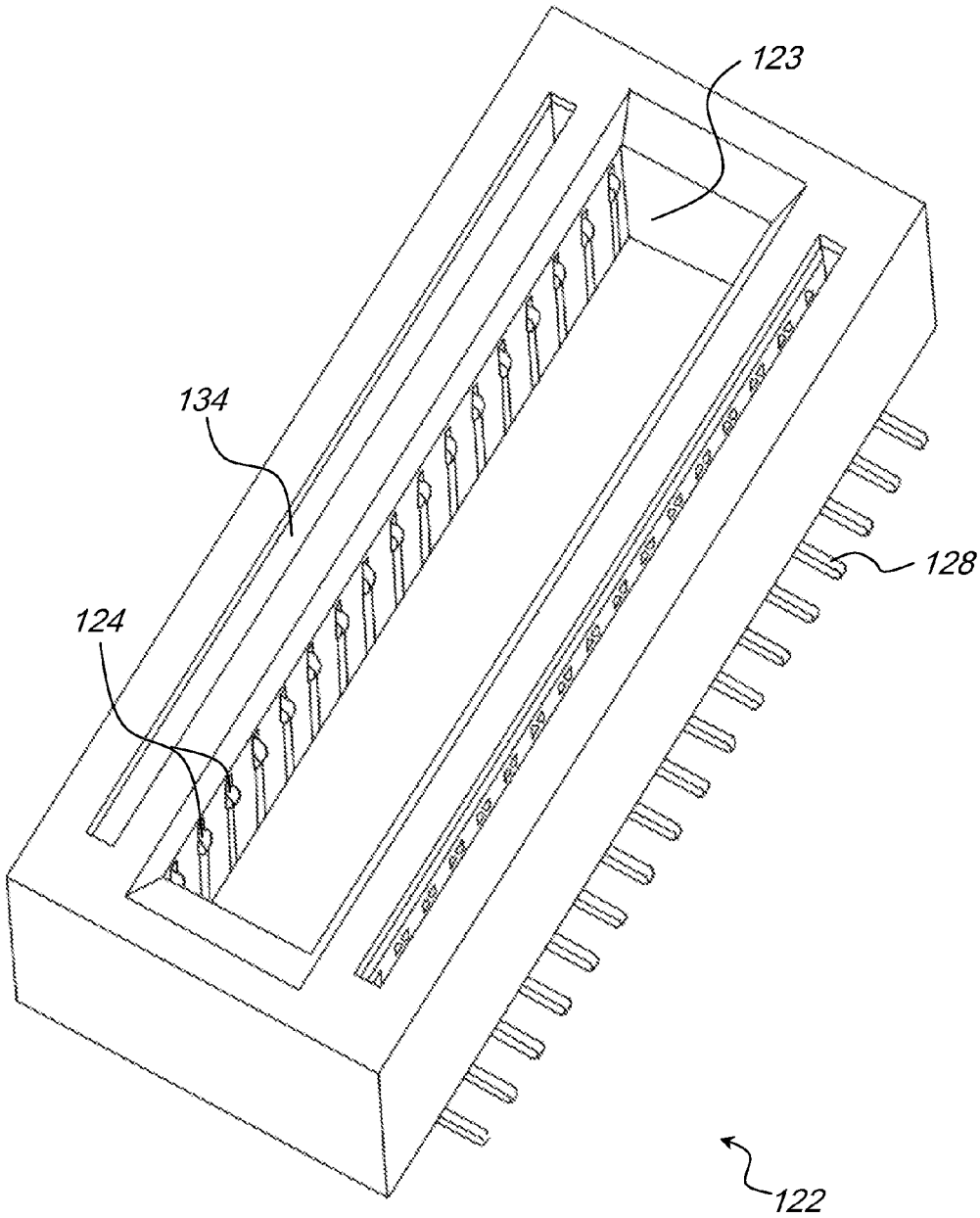
FIG. 6 is a perspective view of a female connector assembly of the electrical connector of FIG. 5.
Figure 7:
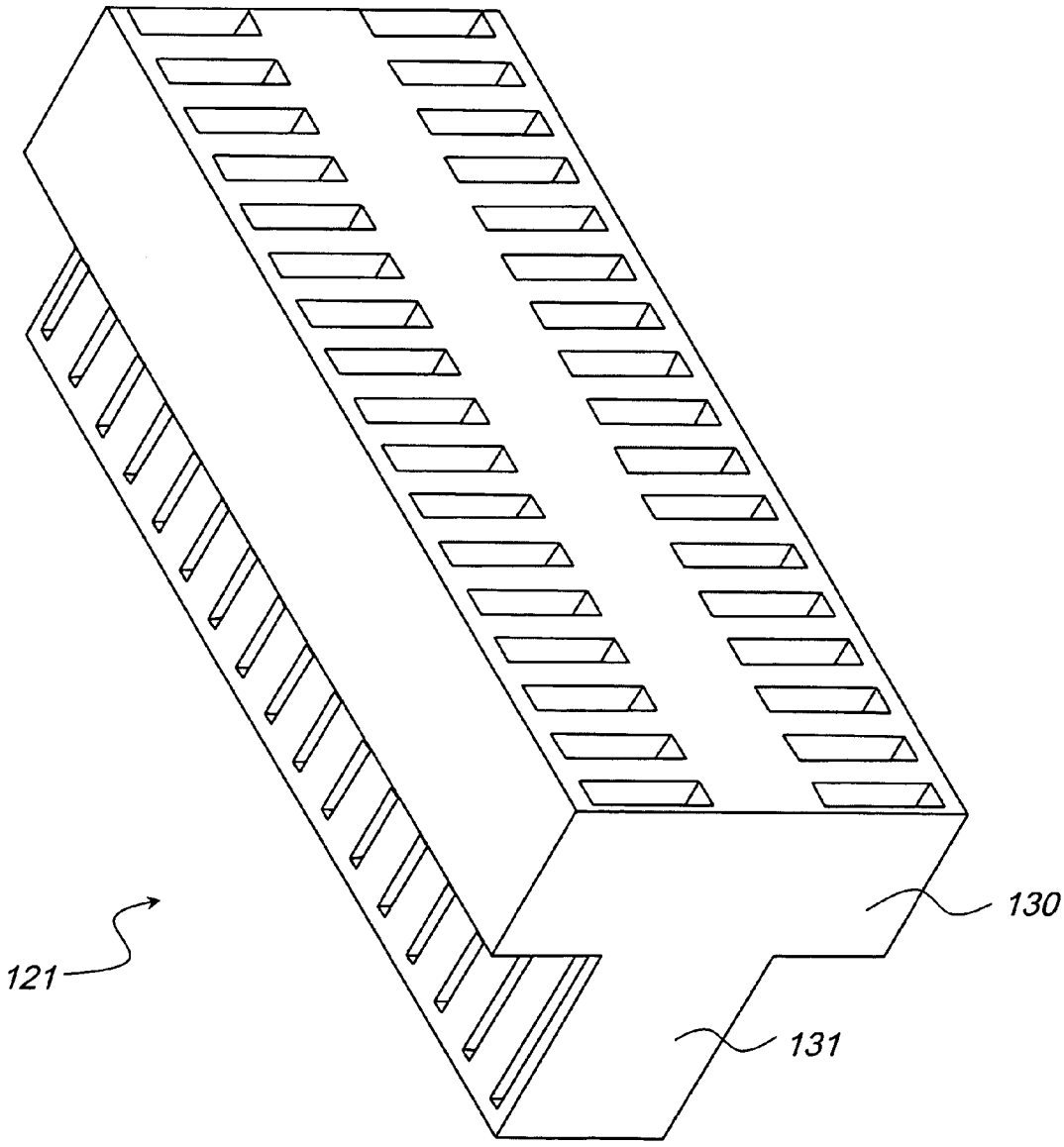
FIG. 7 is a perspective view of a male connector assembly of FIG. 5.
Figure 8:
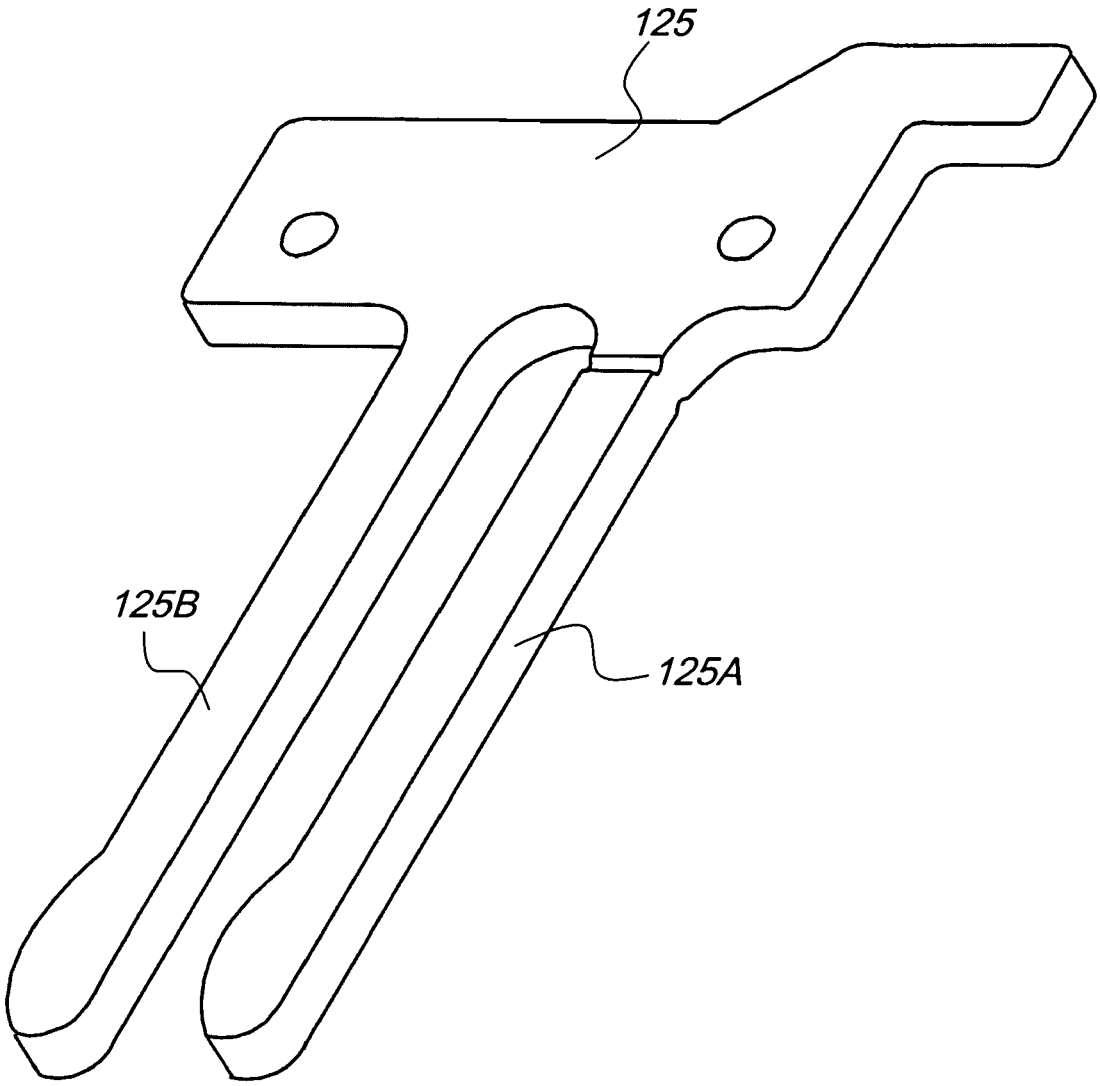
FIG. 8 is a perspective view of an electrical contact used with the male connector assembly of FIG. 7.

FIGS. 5–11 illustrate a second embodiment of the present invention, a board-to-board type electrical connector 120 including a male connector assembly 121 and a female connector assembly 122 adapted to receive the male connector assembly 121 in electric communication. Both housing portions 121, 122 are adapted to receive electrical signals from an attached device. The female connector assembly 122 further includes a pair of independently configurable ground plates 30 adapted to provide any desired pattern of grounding thereto. The electrical connector includes a female connector assembly 122 having a generally open central slot 123 for receiving the compatible male connector assembly 121 in electrical communication. The central slot 123 further includes a plurality of electrical contact receptors 124 positioned therein. The male connector assembly 121 includes a plurality of sequentially disposed electric contacts 125. These electric contacts 125 are typically disposed as two rows, one on either elongated side of the male connector assembly 121. Further, each male electric contact 125 preferably has two elongated prongs 125A and 125B extending therefrom, as is illustrated in FIG. 8.

As noted above, the female connector assembly 122 includes a plurality of electrical contact receptors or sockets 124 for receiving the first elongated prongs 125B of the male electrical contacts 125 in electric communication. The plurality of electrical contact receptors 124 is generally arranged one or more rows to match the rows of electric contacts 125 on the male connector assembly 121. However, the male electric contacts 125 and the female electric contact receptors 124 could be disposed according to any convenient geometry.

Figure 9:
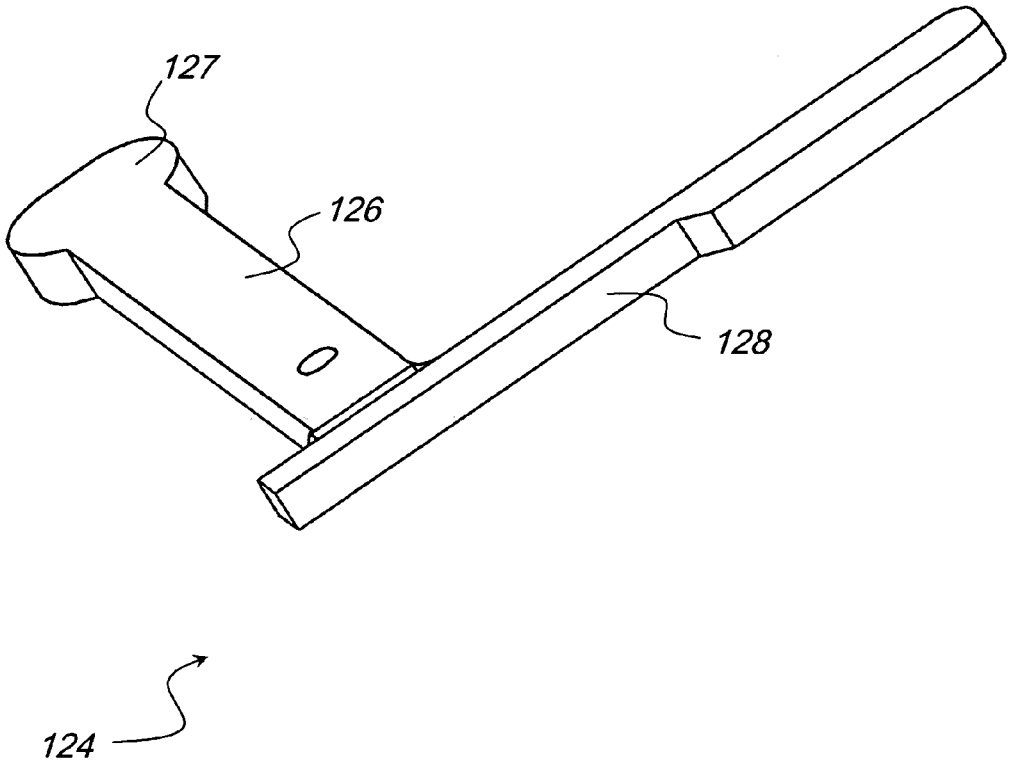
FIG. 9 is a perspective view of a female electrical contact receptor used with the female connector assembly of FIG. 6.

As illustrated in FIG. 9, each electrical contact receptor 124 comprises an elongated electrically conducting member 126 having a rounded contact tip 127 extending therefrom. The elongated electrically conducting member is adapted to extend into the female connector assembly 122 with the rounded contact tip protruding into the slot 123. A first elongated prong 125B of a male electric contact 125 positioned on a male connector assembly 121 inserted into the female connector assembly 122 would be held in electrical communication with the electrical contact receptor 124, as shown in FIG. 6. The electrical contact receptor 124 also includes a second elongated portion 128 adapted to extend from the female connector assembly 122 for electrical connection to a device, such as a printed circuit board.

Figure 10:
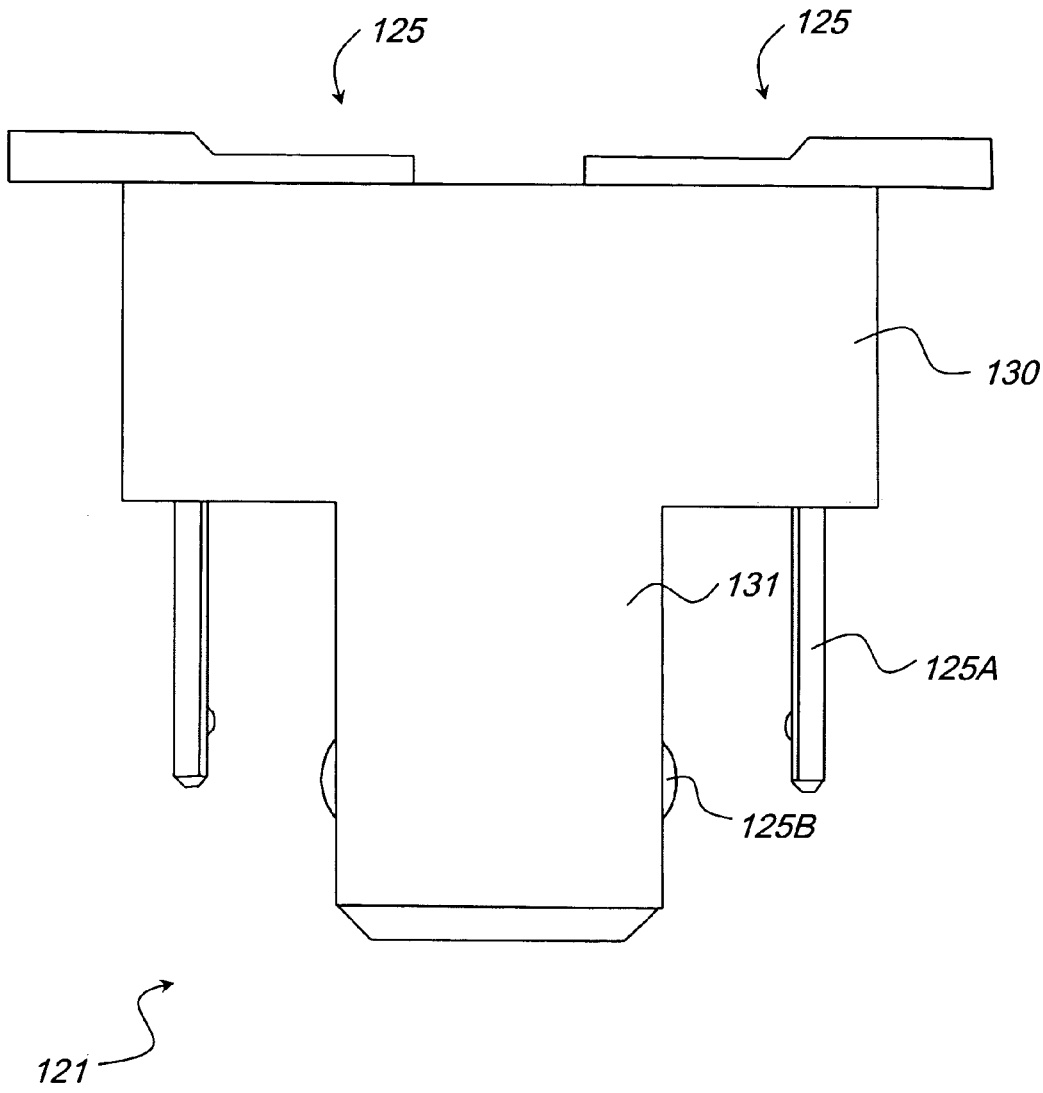
FIG. 10 is an end elevational view of the male connector assembly of FIG. 7 including the electrical contact of FIG. 8.

As shown in FIG. 7, the male connector assembly preferably has a T-shaped cross-section with a top bar portion 130 and an elongated portion 131 adapted to extend into the central slot 123 when the male connector assembly 121 is joined with the female connector assembly 122. As shown in FIG. 10, the electrical contacts 125 are inserted into the male connector assembly 121 such that the first elongated prong 125B extends through the elongated portion 131 and at least partially protrudes therefrom. The second elongated prong 125A extends through the top bar portion 130.

Figure 11:
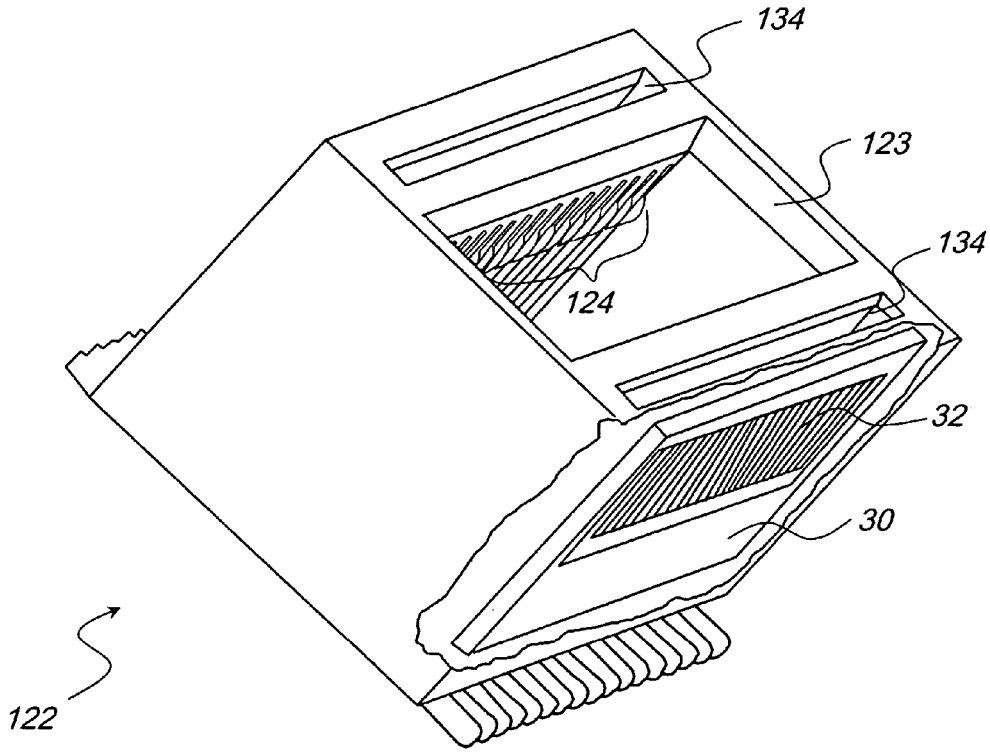
FIG. 11 is a partial sectional view of the female connector assembly of FIG. 6 showing the placement of a ground plate therein.

As illustrated in FIG. 11, the female connector assembly 122 further includes one or more ground plates 30 positioned adjacent one or more grounding slots 134 formed therein. As discussed above and shown in FIGS. 4A and 4B, the ground plates 30 are made of an electrically conducting material, such as copper or steel. The ground plates 30 include a plurality of individual elongated finger portions 32 formed therein. Each ground plate 30 is oriented such that the fingers 32 are substantially adjacent and spaced from the second elongated prongs 125B when the male and female connector assemblies 121, 122 are mated. The finger portions 32 preferably extend parallel to the first elongated prongs 125A and are positioned such that each first elongated prong 125A of a male electrical contact 125 on a male connector assembly 121 inserted into the female connector assembly 122 is spaced opposite a finger portion 32. In other words, each male first elongated prong 125A and at least one respective finger portion 32 are positioned substantially adjacently, such that the finger portion 32 may be bent sufficiently inwardly toward the male second first prong 125A to make electrical contact therewith. Since the ground plate 30 is electrically grounded, contact by a male first elongated prong 125A with a finger portion 32 will electrically ground the associated male second elongated prong 125B, any electrical receptor 124 in contact with the associated male second elongated prong 125B, as well as any device electrically connected thereto.

As with the electrical connector 20 embodiment discussed above, the electrical connector 120 is preferably produced with all of the finger portions 32 oriented flush with their respective ground plate 30, i.e., unbent, although the electric connector 120 may be produced with one or more of the finger portions 32 bent. The electrical connector 120 may therefore be readily modified to have any desired connector ground pin configuration by simply bending the appropriate fingers 32 inwardly to ground the desired male electrical contact 121 positions (the bending may be done manually by the end user, mechanically, or during the stamping or forming process). The electrical connector 120 may thusly be customized at any time during or after production, increasing its utility and flexibility of use. Customization may be done in bulk following manufacture to address a technical requirement. Alternately, the electrical connectors 120 may be sold as manufactured and customized in the field to meet the specific needs of an individual user.

In operation, predetermined fingers 32 are urged into electrical contact with pre-selected electrically conducting members 26 (or male electrical contacts 125), thereby electrically connecting pre-selected contact receptors 24/contacts 125 to a common ground plate 30. Which contact receptors 24/contacts 125 are grounded to the ground plate 30 is predetermined according to the configuration of the device or devices to be mated to the electrical connector 20/120. In other words, the end user determines which contact receptors 24/contacts 125 are to be connected to the ground plate 30 based on the wiring of the device connected to the electrical connector 20/120. Electrical contacts (not shown) extending from the device(s) are electrically connected to the electrical connector 20; those contacts received by electrical connector such that they are ultimately in electric communication with the fingers 32 urged are thusly grounded by the ground plate 30.

Preferably, two ground plates 30 are provided and oriented in parallel, such that each respective finger 32 of each ground plate 30 is paired with an opposite respective finger 32 of the other ground plate 30. The fingers 32 are spaced a finite, non-zero distance apart sufficient to accommodate the placement of a conductor partially filling the space in between the fingers 32. In other words, there is sufficient room between the unbent fingers 32 for the insertion of at least one electrically conducting member therebetween such that the neither finger 32 electrically contacts the electrically conducting member. The fingers 32 may be plastically deformed (i.e., bent) towards one another such that at least one finger 32 electrically connects with an electrically conducting member, such as an electrical contact receptor 124 or an electric contact 125, positioned therebetween and desired to be grounded. However, other designs are contemplated having only a single ground plate 30 or multiple asymmetrically disposed ground plates 30.

Another preferred embodiment of the present invention will now be described with reference to FIGS. 12–19.

FIGS. 12–15 show a male connector portion and FIGS. 16–19 show a female connector portion of a connector or connector system according to another preferred embodiment of the present invention.

As seen in FIGS. 12–15, the male connector portion 210 includes an insulating housing 212 having one or more cavities for accommodating a plurality of contact pins 214 therein. The housing 212 also preferably includes a mating member 212*a* preferably in the form of a recess in the male connector portion 210 for mating with a mating member of the female connector portion as described below. The housing 212 also preferably includes mounting pins 212*b* provided on a bottom surface thereof for mounting to a printed circuit board.

Figure 12:
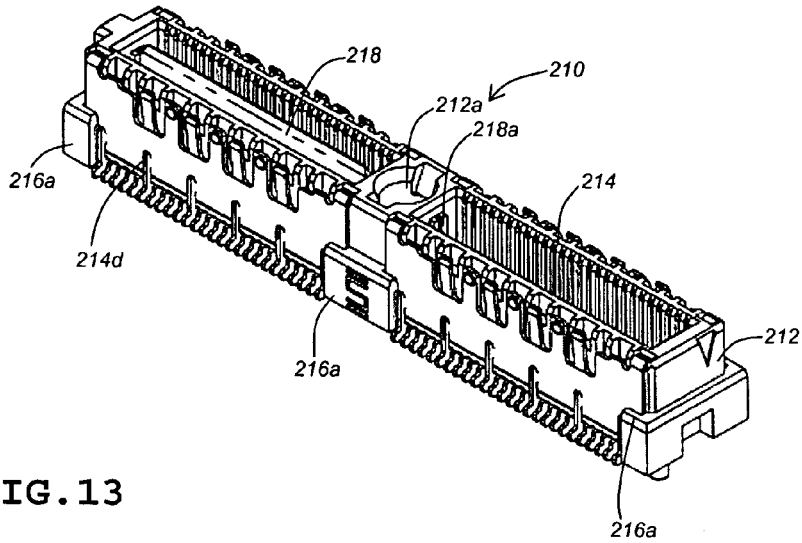
FIG. 12 is an isometric view of a male connector portion according to a preferred embodiment of the present invention.

The plurality of contact pins 214 are preferably arranged in one or more rows along a wall(s) of the housing 212 as seen in FIG. 12. The plurality of contact pins 214 preferably have the unique configuration shown in FIG. 15 which will be described in more detail later. In addition, as will be described in more detail later, each of the contact pins 214 is adapted to be used as a signal contact pin or a shield contact pin, as desired.

Figure 13:
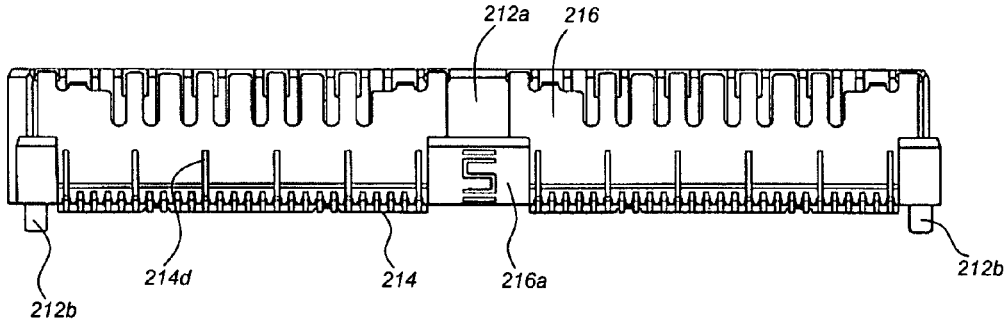
FIG. 13 is a side view of the male connector portion of FIG. 12.

One or more shield plates 216 are provided on the outer portion of the housing 212. The shield plates 216 are made of a suitable conductive metal or plating-on-plastic, or other suitable material. The shield plates 216 are preferably held in place by shield plate holders 216*a*. As seen in FIG. 13, the shield plates 216 are preferably formed from a metal stamping and are preferably made to have a uniform dimension and configuration. This allows the shield plates 216 to be used on any type of connector and to be arranged in any pattern desired. In the preferred embodiment shown in FIGS. 12–15, for example, there are preferably four shield plates 216 provided, two plates 216 provided on each of the opposite longitudinal outer surfaces of the housing 212. It should be noted that the illustrated arrangement of the shield plates 216 depicted in FIGS. 12 and 13 is not limiting and other arrangements can be used. For example, shield plates 216 may also be provided on the two shorter ends of the housing 212 for increased shielding, as desired.

Figure 14:
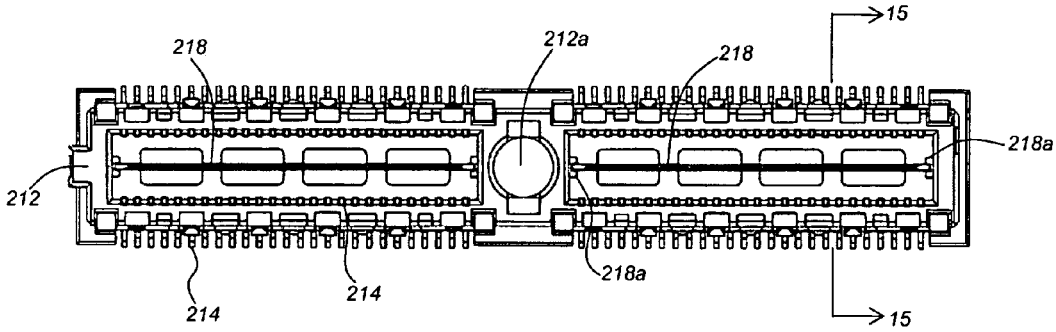
FIG. 14 is a top view of the male connector portion of FIG. 12.

One or more ground planes 218 are provided in the housing and are held in position by ground plane holders 218*a*. The ground planes 218 are located between the opposite rows of contact pins 214 to prevent cross-talk between adjacent rows of contact pins 214. The ground planes 218 can be provided in each cavity of the housing or in selected cavities in the housing. As is shown in FIG. 12, there is one ground plane 218 in one cavity (the left cavity) and no ground plane in the other cavity (the right cavity). As seen in FIG. 14, there is a ground plane 218 provided in each cavity and between each pair of opposite rows of contact pins 214.

Figure 15:
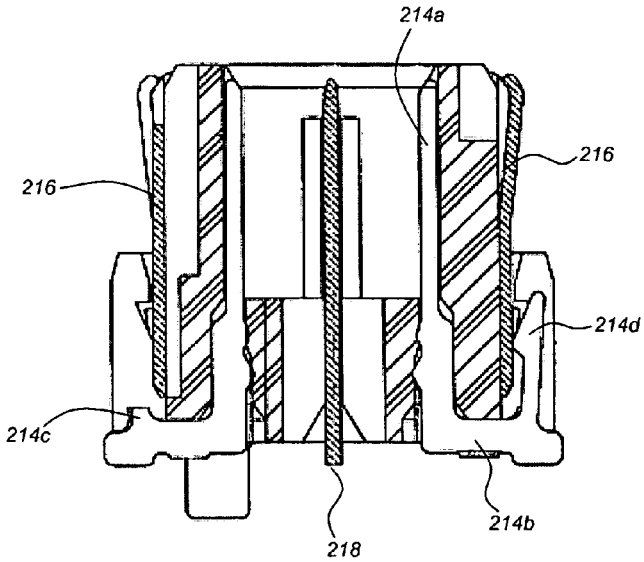
FIG. 15 is a sectional view of the male connector portion along line 15—15 in FIG. 14.
Figure 16:
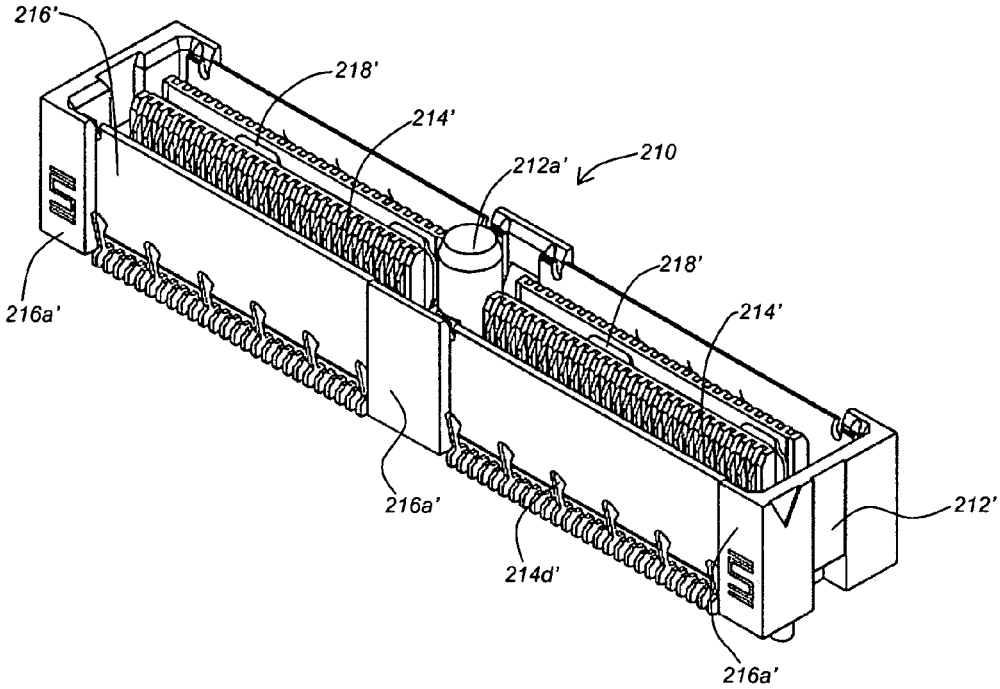
FIG. 16 is an isometric view of a female connector portion according to a preferred embodiment of the present invention.
Figure 17:
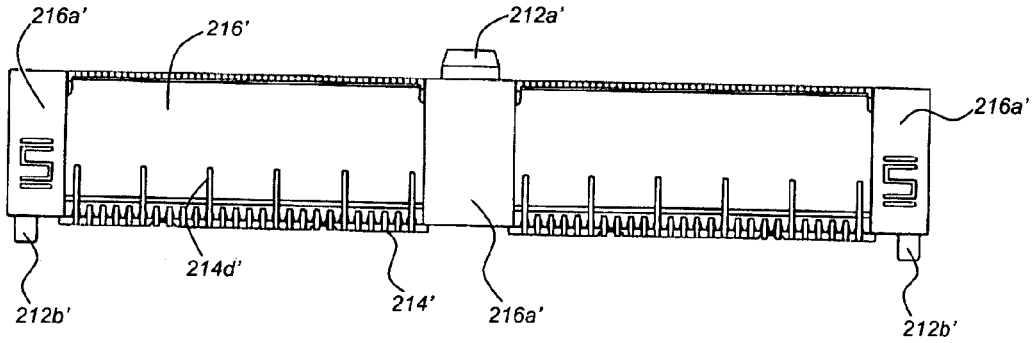
FIG. 17 is a side view of the female connector portion of FIG. 5.
Figure 18:
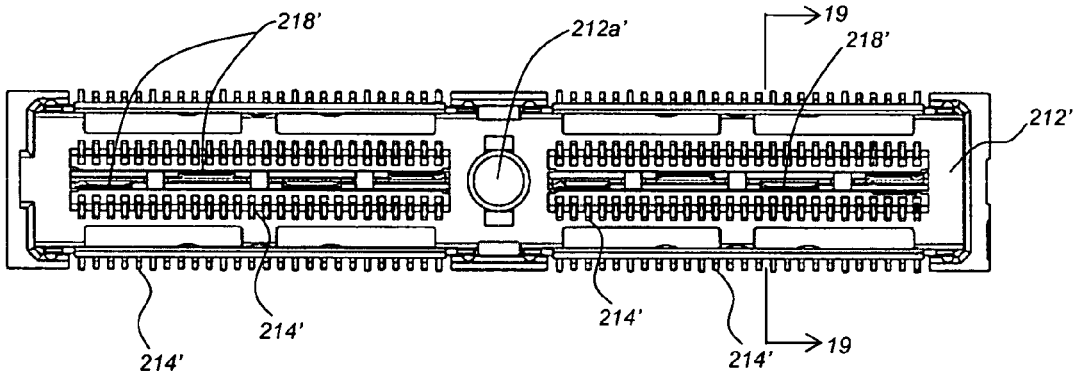
FIG. 18 is a top view of the female connector portion of FIG. 17.
Figure 19:
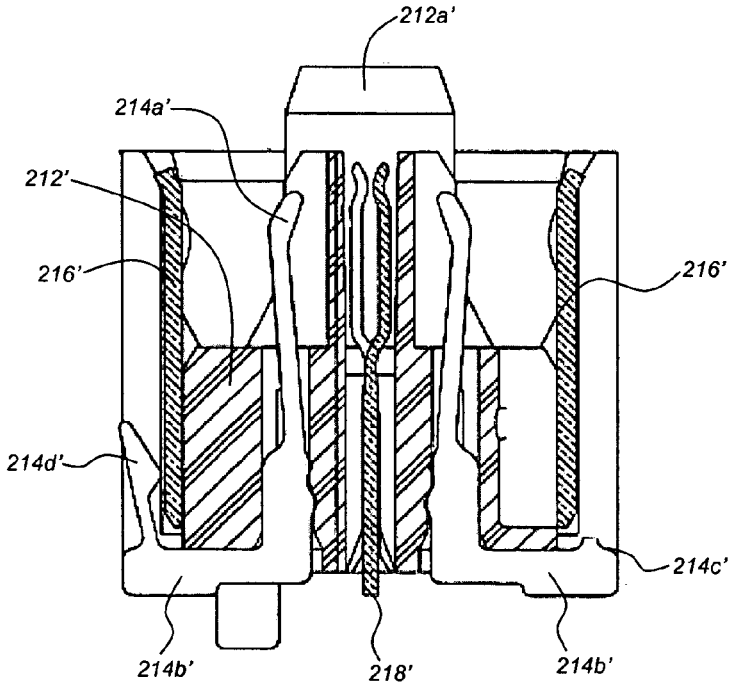
FIG. 19 is a sectional view of the female connector portion along line 19—19 in FIG. 18.

As seen in FIG. 15, the contact pins 214 have a unique configuration. The contact pins 214 are preferably made of a suitable conductive metal and formed from a metal stamping or from plating-on-plastic. Each of the contact pins 214 includes a main portion 214*a* disposed in the housing 212, a bottom portion 214*b* extending along a bottom surface of the housing 212, a burr portion 214*c* extending from the bottom portion 214*b*, and a shield contact portion 214*d* extending up from the burr portion 214*c* and arranged so as to contact the shield plate 216.

The main portion 214*a* makes electrical contact with other contact pins in another mating connection portion. The bottom portion 214*b* may be electrically connected to conductive pads or elements, such as ground, provided on a circuit board upon which the connector portion 210 is mounted. The burr portion 214*c* is formed when the shield contact portion 214*d* is removed as will be described later. It is important to note that the burr portion 214*c* does not physically contact the shield plate 216. Thus, for the electrical contacts 214 that have the burr portion 214*c* and do not have the shield contact portion 214*d*, there is no electrical connection between the contact 214 and the shield plate 216. Thus, these contacts 214 are used as signal contacts or pins.

For the electrical contacts 214 in which the shield contact portion 214*d* is not removed, there is a physical and electrical connection between the electrical contact 214 and the shield plate 216. No burr portion 214*c* is provided in these types of electrical contacts 214. Thus, these electrical contacts 214 having the shield contact portion 214*d* are used as shield contacts or pins.

As can be seen in FIG. 15, the electrical connection between the shield contacts 214 and the shield plates 216 is preferably located at an outer surface of the connector housing 212. The pattern or arrangement of the shield contacts 214 can be selectively determined according to application and performance requirements.

Accordingly, there is no need to provide separate signal contacts and shield contacts as is required with conventional devices. In addition, the pattern of shield contacts and signal contacts may be changed and customized easily and without making any change to the stamping used to form the contacts 214 or the arrangement of the contacts 214 or shield plates 216. Further, each of the signal contacts and shield contacts initially have the same construction, thus allowing for use of uniform contacts for each of the signal contacts and shield contacts. This provides for an easier, less expensive and more efficient manufacturing process.

A preferred method of manufacturing the connector of the present invention will now be described. The housing 212 is preferably formed of an insulating material to have a desired dimension and configuration, as is well known. The ground plates 218 and the shield plates 216 are formed separately and preferably so that the ground plates 218 have a uniform shape and configuration and so that the shield plates 216 have a uniform shape and configuration. The ground plates 218 are then mounted in the housing 212 and held in position by the holders 218*a*, and the shield plates 216 are also mounted to the housing 212 and held by the holders 216*a*. The holders 216*a* and 218*a* are preferably integrally formed in the housing 212.

The electrical contact pins 214 are preferably manufactured from a suitable metal to form a bank of interconnected contacts 214 including the main portion 214*a*, the bottom portion 214*b*, and shield contact portion 214*d*.

Before the electrical contacts are stitched or inserted into the housing 212, selected ones of the shield contact portions 214*d* are removed to form a customized pattern of shield contact pins and signal contact pins. Alternatively, after the electrical contacts are stitched or inserted into the housing 212, selected ones of the shield contact portions 214*d* are removed to form a customized pattern of shield contact pins and signal contact pins.

The selected shield contact portions 214*d* are preferably removed by cutting, or other suitable removal process. The cutting of the shield contact portions 214*d* from the rest of the contacts forms a burr portion 214*c*. As a result, the bank of interconnected contacts includes shield contact pins and signal contact pins. In one embodiment, the bank of shield contact pins and signal contact pins are formed and then stitched into or mounted in the housing 212 so that the shield contact portions 214*d* physically contact a respective shield plate 216 and so that the main portions 214*a* are arranged in one or more rows inside of the housing. Alternatively, the bank of contacts 214 are inserted into the housing 212, selected ones of the shield contact portions 214*d* are removed to form a customized pattern of shield contact pins and signal contact pins, such that the shield contact portions 214*d* physically contact a respective shield plate 216 and so that the main portions 214*a* are arranged in one or more rows inside of the housing.

FIGS. 16–19 show the female connector portion 210' which includes a similar corresponding construction including an insulating housing 212' having mounting pegs 212*b* and a mating member 212*a'* preferably in the form of a pin that mates with the mating member 212*a* of the male connector portion 210, a plurality of electrical contact pins 214', a plurality of shield plates 216', and a plurality of ground planes or blades 218'. The plurality of electrical contact pins 214', shield plates 216', and ground planes or blades 218' are arranged and configured to mate with the respective contact pins 214, shield plates 216 and ground planes 218 of the male connector portion 212. The female connector portion 210' is preferably manufactured using a process that is the same or similar to that described above with reference to the manufacture of the male connector portion 210.

The many advantages and improvements achieved by the preferred embodiments of the present invention will now be described. The combination of the shield plates 218 and the ground planes 216 minimize cross talk between signal contact pins and provide impedance control, and the shield plates 218 minimize EMI being emitted from and input to the connector, so as to provide a connector having excellent electrical characteristics. Furthermore, it is not necessary to provide a shield plane or plate on the printed circuits board upon which the connector system is mounted. In addition, impedance matching is achieved with a much more accurate matching than with conventional devices. The shield plate serves as a return path for the signal and is coupled to the pin transmitting the signal, thereby controlling impedance.

In addition, the unique structure and arrangement of the connector system of the present invention eliminates the need to manufacture specific shield plates and ground planes according to each type of connector and instead, allows one type of shield plate and one type of ground plane to be used for all types of connectors. Furthermore, the unique structure and arrangement of the contact pins allows each contact pin to be used either as a signal pin or a shield contact pin as desired. Also, it is very easy to selectively design a unique, customized pattern of contact pins according to shielding and signal requirements, without having to provide and specially arrange separate signal contact pins and shield contact pins.

With this easy pin customization feature, it is very easy to selectively arrange the electrical contact pins as either single ended contact pins or differential pair contact pins, without having to change the structure or arrangement of the contact pins at all.

Also, because the shield contact pins connected to the shield plates have a bottom portion 214*b*, 214*b'* extending along a bottom surface of the connector housing 210, 210', there is minimal distance from the shield to the printed circuit board upon which the connector is mounted resulting in improved electrical performance and ease of surface mounting.

The present invention can be applied to many different types of connectors such as those described above and shown in FIGS. 12–19 and other types of connectors such as differential pair array connectors, single ended array connectors, edge mount connectors and others.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A method for producing an electrical connector, comprising the steps of:

a) providing a housing;

b) providing at least one shield member along an outer surface of the housing;

c) providing a plurality of shield contacts on a carrier strip;

d) forming a plurality of signal contacts from the plurality of shield contacts on the carrier strip by eliminating a portion of a corresponding shield contact; and e) inserting the plurality of signal contacts and the plurality of shield contacts into the housing such that the plurality of shield contacts are electrically connected to the at least one shield member and such that the plurality of signal contacts are not electrically connected to the at least one shield member.

2. The method according to claim 1, wherein the step of eliminating a portion of the corresponding shield contact includes cutting an arm portion of the corresponding shield contact.

3. The method according to claim 1, wherein in step e), the plurality of shield contacts are inserted into the housing such that arm portions of the plurality of shield contacts are in contact with the at least one shield member.

4. The method according to claim 1, further comprising the step of inserting at least one ground member inside of the housing.

5. The method according to claim 4, wherein the at least one ground member is inserted in between at least two rows of the plurality of electrical contacts.

* * * * *